US007044406B2

(12) United States Patent
Potz et al.

(10) Patent No.: US 7,044,406 B2
(45) Date of Patent: May 16, 2006

(54) FUEL INJECTION VALVE FOR AN INTERNAL COMBUSTION ENGINE

(75) Inventors: Detlev Potz, deceased, late of Stuttgart (DE); by Maike Sander-Potz, legal representative, Stuttgart (DE); Thomas Kuegler, Korntal-Muenchingen (DE); Predrag Nunic, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/503,439

(22) PCT Filed: Mar. 26, 2003

(86) PCT No.: PCT/DE03/00991

§ 371 (c)(1),
(2), (4) Date: Aug. 4, 2004

(87) PCT Pub. No.: WO04/001219

PCT Pub. Date: Dec. 31, 2003

(65) Prior Publication Data

US 2005/0139698 A1 Jun. 30, 2005

(30) Foreign Application Priority Data

Jun. 19, 2002 (DE) ..... 102 27 277

(51) Int. Cl.
*F02M 59/00* (2006.01)

(52) U.S. Cl. ..... 239/533.2; 239/533.11; 239/533.12

(58) Field of Classification Search ..... 239/533.11, 239/533.12, 533.3, 533.4, 88
See application file for complete search history.

(56) References Cited

U.S. PATENT DOCUMENTS 4,570,853 A * 2/1986 Schmied ..... 239/116
4,658,824 A * 4/1987 Scheibe ..... 123/472
6,260,775 B1 * 7/2001 Lambert et al. ..... 239/533.3
6,412,712 B1 * 7/2002 Buckley ..... 239/533.12

* cited by examiner

*Primary Examiner*—Dinh Q. Nguyen
(74) *Attorney, Agent, or Firm*—Ronald E. Greigg

(57) ABSTRACT

Disclosed is a fuel injection valve for internal combustion engines having a valve body in which a hollow valve needle is disposed longitudinally displaceably in a bore. The hollow valve needle, on its end toward the combustion chamber, has a conical valve sealing face, which cooperates with a conical valve seat disposed on the end of the bore toward the combustion chamber. A longitudinal bore is embodied in the hollow valve needle, and a valve needle is disposed in it and, with a valve contact face embodied on its end toward the combustion chamber, likewise cooperates with the valve seat. The tip of the hollow valve needle toward the combustion chamber is formed by a chamfer.

6 Claims, 3 Drawing Sheets

FUEL INJECTION VALVE FOR AN INTERNAL COMBUSTION ENGINE

CROSS-REFERENCE TO RELATED APPLICATIONS

This application is a 35 USC 371 application of PCT/DE 03/00991 filed on Mar. 26, 2003.

BACKGROUND OF THE INVENTION

1. Field of the Invention

The invention is directed to an improved fuel injection valve for internal combustion engines.

2. Description of the Prior Art

A fuel injection valve of the type with which this invention is concerned is known for instance from the German Patent Disclosure DE 27 11 391 and has a valve body, in which a hollow valve needle is disposed longitudinally displaceably in a bore. The hollow valve needle, on its end toward the combustion chamber, has a conical valve sealing or contact face, with which it cooperates with a conical valve seat that forms the end of the bore toward the combustion chamber. In the hollow valve needle, an inner or second valve needle is longitudinally displaceable and likewise has a conical valve contact face and cooperates with the valve seat. Both the hollow valve needle and the inner valve needle control the flow of fuel to at least one injection opening each, through which fuel is injected into the combustion chamber of the engine.

In the fuel injection valve known from DE 27 11 391, the tip of the hollow valve needle is flattened, forming an end face that is located in a radial plane of the hollow valve needle. However, this valve needle then has the disadvantage that a relatively large idle volume forms between the hollow valve needle, the inner valve needle, and the valve seat, and this has an unfavorable effect on hydrocarbon emissions of the fuel injection valve.

From DE 27 11 390, a fuel injection valve is also known in which the hollow valve needle has no flattened portion but instead comes to a point at the end. This does reduce the idle volume and thus has a favorable effect on hydrocarbon emissions from the engine but results in a disadvantage that the inner needle can easily become jammed in the outer needle. Because of the contact of the hollow valve needle with the conical valve seat, deformation of the hollow valve needle radially inward readily occurs, so that the already very small annular gap between the valve needle and the hollow valve needle is reduced still further. This can result in increased wear between these two components supported slidably displaceably relative to one another, and this shortens the service life of the fuel injection valve.

SUMMARY AND ADVANTAGES OF THE INVENTION

The fuel injection valve of the invention has the advantage over the prior art that jamming of the inner valve needle in the hollow valve needle is effectively suppressed, and at the same time, hydrocarbon emissions from the fuel injection valve are reduced. To that end, on its tip the hollow valve needle has a chamfer, which preferably directly adjoins the conical valve sealing face. Since the outermost valve tip is now no longer affected directly by the force generated by the pressure of the hollow valve needle against the conical valve seat, there is markedly less indentation of the hollow valve needle, and thus jamming or excessive wear in the motion of the inner valve needle in the hollow valve needle is averted. At the same time, the volume between, or defined by the hollow valve needle, the inner valve needle and the valve seat, if both the inner valve needle and hollow valve needle are contacting the valve seat, is so slight that no significant increase in the hydrocarbon emissions from the engine occurs.

BRIEF DESCRIPTION OF THE DRAWINGS

The foregoing and other features of the invention will become more apparent from the detailed description of one exemplary embodiment of the fuel injection valve of the invention contained herein below, taken in conjunction with the drawings, in which.

DESCRIPTION OF THE PREFERRED EMBODIMENT

Figure 1:
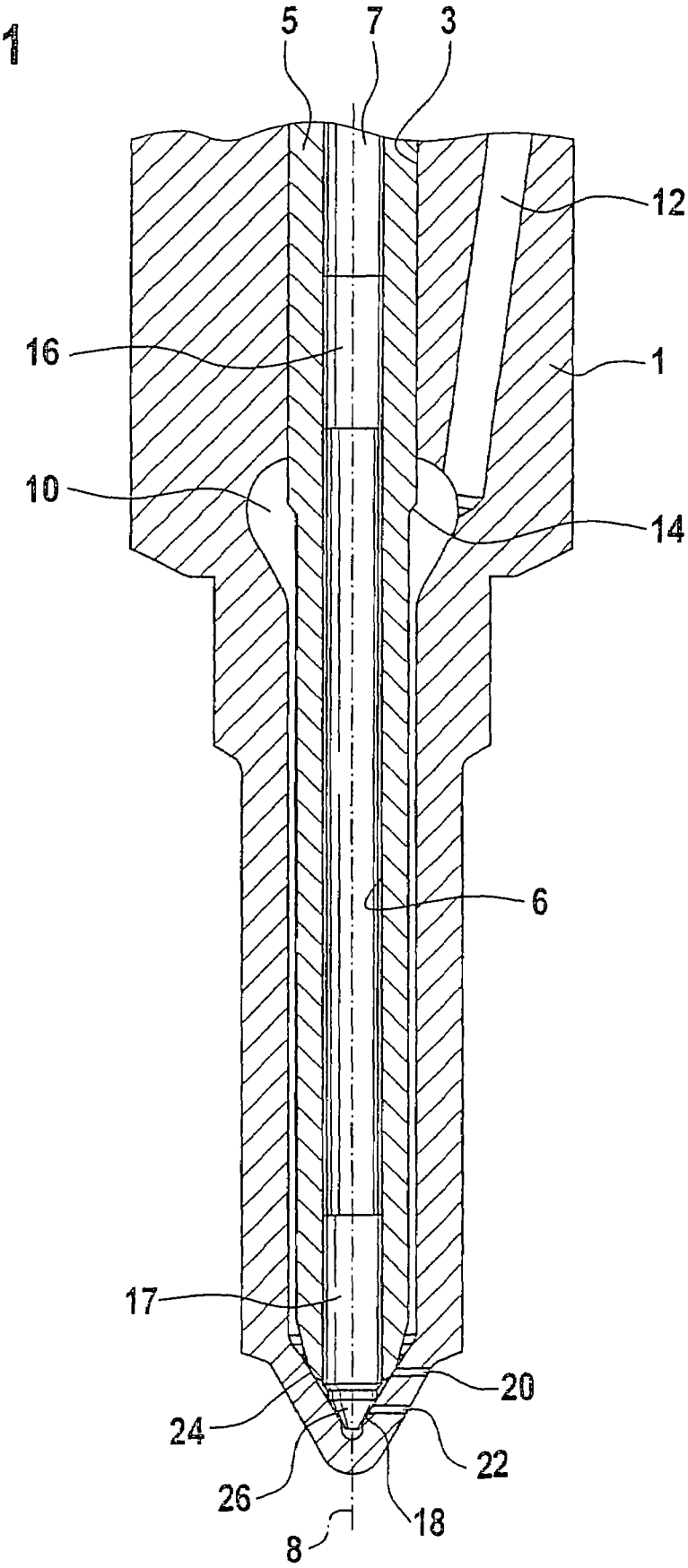
FIG. 1 shows a valve body according to the invention, in longitudinal section.

In FIG. 1, a longitudinal section is shown through a fuel injection valve of the invention. In a valve body 1, there is a bore 3, on whose end toward the combustion chamber a conical valve seat 10 is embodied. A piston-shaped hollow valve needle 5 is longitudinally displaceable in the bore 3, which has a longitudinal axis 8. In a portion remote from the combustion chamber, the hollow valve needle 5 is guided sealingly in the bore 3 and tapers toward the valve seat 18, forming a pressure shoulder 14. On its end toward the combustion chamber, the hollow valve needle 5 has a conical valve sealing face 24, which comes to rest on the valve seat 18 in the closing position of the hollow valve needle 5. A pressure chamber 10 is embodied between the hollow valve needle 5 and the wall of the bore 3 and is radially enlarged at the level of the pressure shoulder 14. An inlet conduit 12, by way of which the pressure chamber 10 is filled with fuel at high pressure, is embodied in the valve body 1 and discharges into the radial enlargement of the pressure chamber 10.

The hollow valve needle 5 has a longitudinal bore 6, whose longitudinal axis coincides with the longitudinal axis 8 of the hollow valve needle 5. An inner valve needle 7 is disposed longitudinally displaceably in the longitudinal bore 6 and on its end toward the combustion chamber has a conical valve contact face 26, which likewise comes to rest on the valve seat 18 in the closing position of the valve needle 7. A first guide portion 16 remote from the combustion chamber and a second guide portion 17 toward the combustion chamber are embodied on the valve needle 7, and in these portions the valve needle is guided relatively closely in the hollow valve needle 5. The play between the second guide portion 17 and the wall of the longitudinal bore 6 is very slight, preferably less than 10 μm. Between these two guide portions 16, 17, a relatively large annular gap is formed between the valve needle 7 and the wall of the longitudinal bore 6, so that the valve needle 7 is actually guided only at the two guide portions 16,17.

Figure 2:
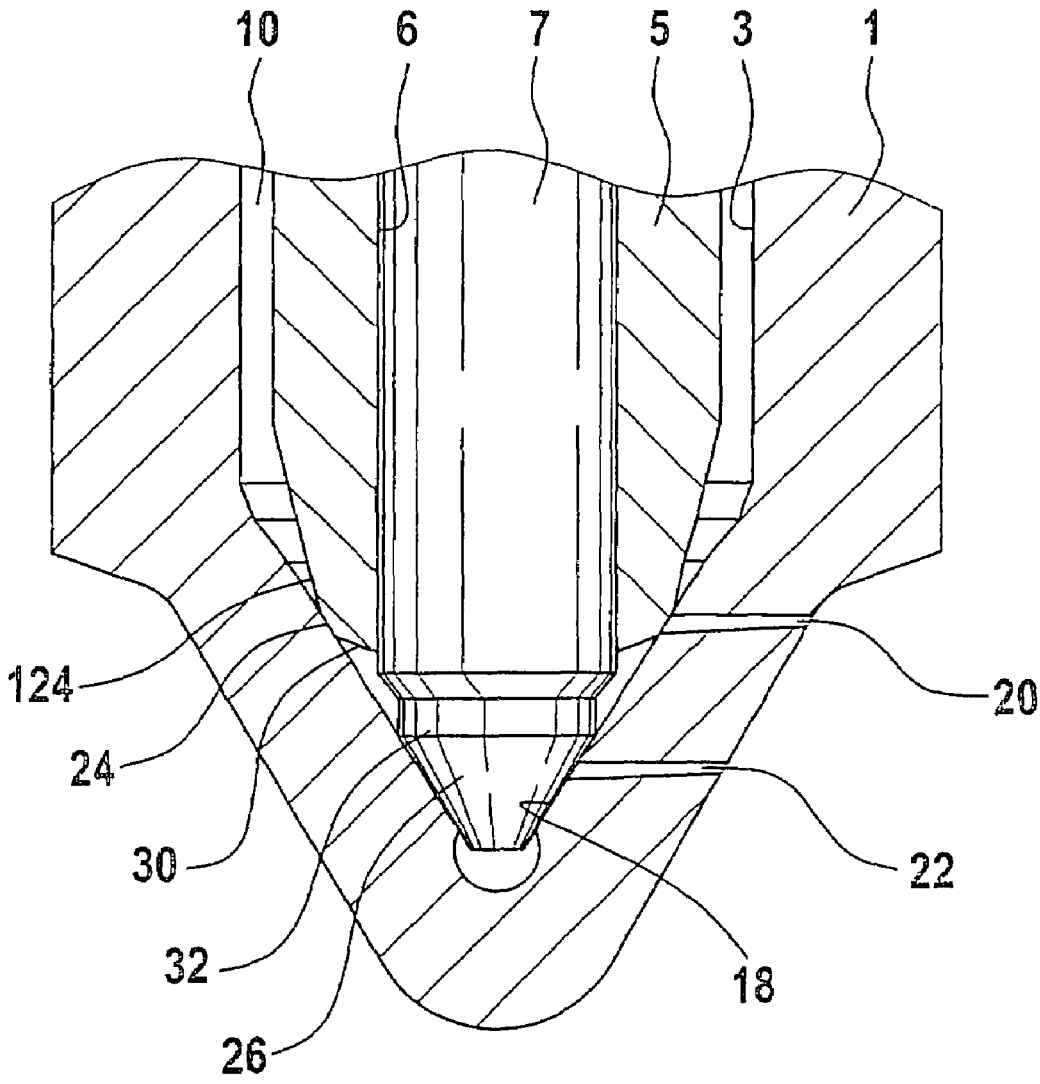
FIG. 2 is an enlargement of FIG. 1 in the region of the valve seat, showing the hollow valve needle in section.
Figure 3:
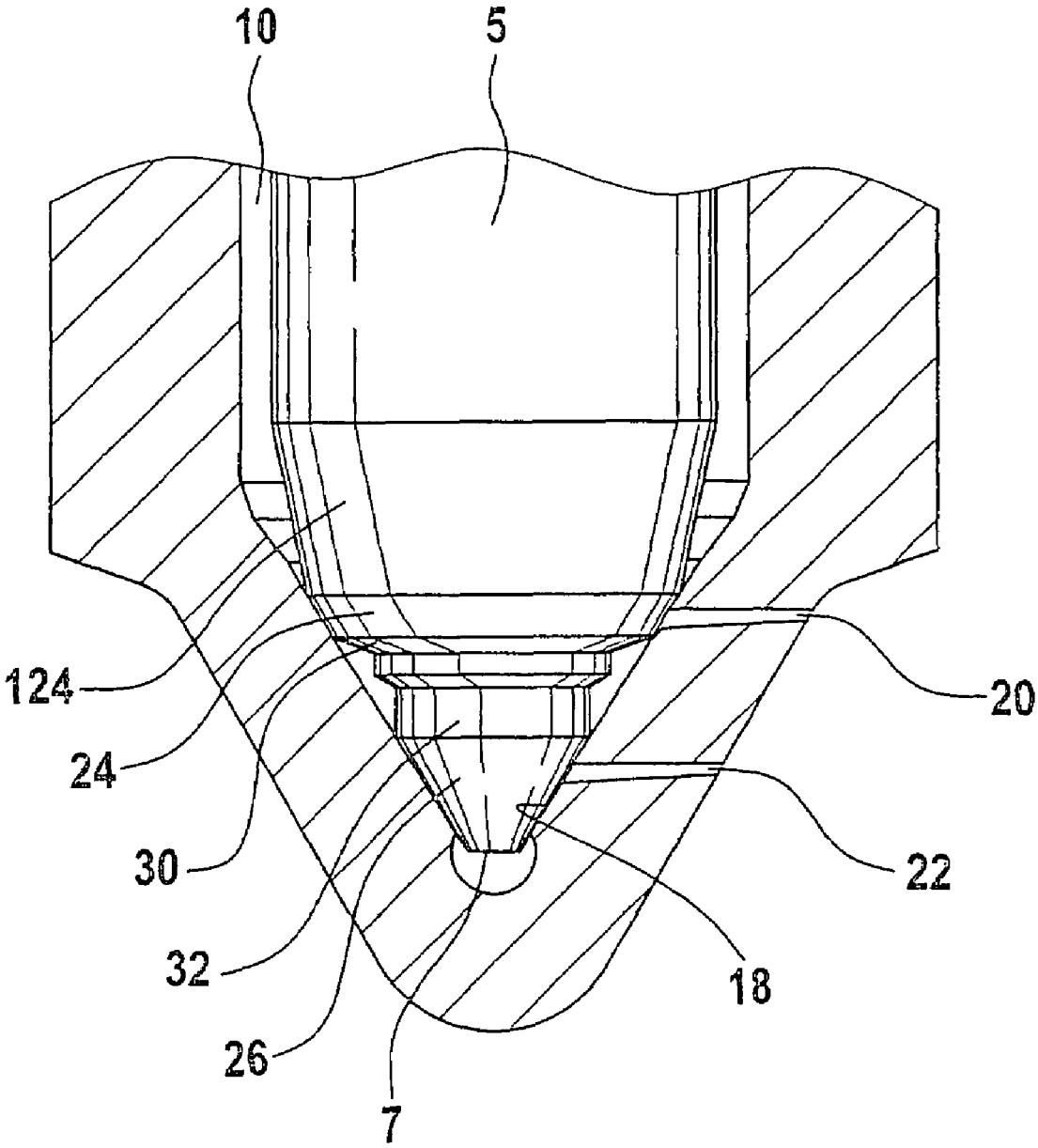
FIG. 3 shows the same detail as FIG. 2, but here the hollow valve needle is shown not in section.

Beginning at the valve seat 18, outer injection openings 20 and inner injection openings 22 are embodied in the valve body 1; preferably a plurality of these openings are distributed over the circumference of the valve body 1. FIG. 2 in this respect shows an enlargement of FIG. 1 in the region of the valve seat 18, and FIG. 3 shows the same detail as FIG. 2, but in it the hollow valve needle 5 is not in section. The hollow valve needle 5, in its closing position, rests on the valve seat 18, and the valve sealing face 24 closes the outer injection openings 20. The valve needle 7, with its valve contact face 26, likewise closes the inner injection openings 22. An annular groove 32 is formed on the valve needle 7, defined on one side by the cylindrical portion of the valve needle 7 and on the other side by the valve contact face 26. As a result of this annular groove 32, an engagement face is created for the fuel pressure of the pressure chamber 10, when the pressure acts on the valve needle 7.

Both the hollow valve needle 5 and the valve needle 7 are acted upon, by a device not shown in the drawing, such as a spring, with a closing force in the direction of the valve seat 18, so that in the absence of other forces, they remain in their closing position. By the introduction of fuel at an appropriate injection pressure into the pressure chamber 10 of the valve body 1, a hydraulic force on the pressure shoulder 14 is created which is oriented counter to the closing force on the hollow valve needle 5. If this hydraulic force exceeds the closing force, then the hollow valve needle 5 lifts from the valve seat 18 and uncovers the outer injection openings 20, through which fuel is injected into the combustion chamber of the engine. The valve needle 7 initially remains in its closing position, until the hydraulic pressure now operative on the pressure shoulder, which is formed by the annular groove 32, suffices to overcome the closing force on the valve needle 7. If the valve needle 7 also moves out of its closing position, then the injection of fuel takes place not only through the outer injection openings 20 but also through the inner injection openings 22. Conversely, if injection is to be done only through the outer injection openings 20, then the closing force on the valve needle 7 is kept so high that the valve needle does not move out of its closing position in response to the hydraulic pressure. In this way, it is possible for only part of the entire injection cross section or the entire injection cross section to be opened for the injection of fuel into the combustion chamber of the engine.

On the end of the hollow valve needle 5 toward the combustion chamber, besides the valve sealing face 24, which comes to rest on the valve seat 18 in the closing position of the hollow valve needle 5, a further conical face 124 is embodied in this exemplary embodiment; it adjoins the valve sealing face 24 and extends as far as the cylindrical region of the hollow valve needle 5. The valve sealing face 24 is adjoined, toward the valve seat 18, by a chamfer 30, which forms a conical face. As a result, the chamfer 30 is inclined relative to the radial plane of the longitudinal axis 8. However, the cone that forms the conical face of the chamfer 30 has a larger opening angle than the valve sealing face 24. On the one hand, the chamfer 30 prevents the hollow valve needle 5 from experiencing a radially inward-oriented force on its end toward the combustion chamber that would result from its contact with the conical valve seat 18 and would make jamming of the valve needle 7 in the hollow valve needle 5 possible. However, in the region of the valve sealing face 24, the hollow valve needle 5 has a sufficient wall thickness so that because of the closing force on the hollow valve needle 5, only a very slight indentation in the radial direction occurs, and the valve needle 7 maintains adequate mobility in the longitudinal bore 6. In contrast to a flattened face, however, the chamfer 30 also assures that the space between the hollow valve needle 5 the valve needle 7, and the valve seat 18 does not become too large. Since the angles of inclination of the valve sealing face 24, valve contact face 26 and valve seat 18 are optimized in such a way that sealing of the injection openings 20, 22 from the pressure chamber 10 is assured, it can happen that fuel from the hollow space formed between the valve seat 18 and the valve needles 5, 7 will reach the combustion chamber of the engine in the intervals between injections through the injection openings 20, 22 and cause increased hydrocarbon emissions there. This volume can be minimized, without impairing the wear reduction, by means of an appropriate angle of inclination of the chamfers 30.

The foregoing relates to preferred exemplary embodiment of the invention, it being understood that other variants and embodiments thereof are possible within the spirit and scope of the invention, the latter being defined by the appended claims.

The invention of the claimed is:

1. In a fuel injection valve for internal combustion engines, having a valve body (1), in which a hollow valve needle (5) is disposed longitudinally displaceably in a bore (3) and on its end toward the combustion chamber has a conical valve sealing face (24) that cooperates with a conical valve seat (18), disposed on the end toward the combustion chamber of the bore (3), and having a longitudinal bore (6), embodied in the hollow valve needle (5), in which bore a valve needle (7) is disposed that, with a valve contact face (26) embodied on its end toward the combustion chamber, likewise cooperates with the valve seat (18), the improvement comprising a chamfer (30) forming a conical face on the end of the hollow valve needle (5) toward the combustion chamber, wherein the cone that forms the conical face of the chamfer (30) has a larger opening angle than the valve sealing face (24).

2. The fuel injection valve of claim 1, wherein the conical face formed by the chamfer (30) directly adjoins the conical valve sealing face (24).

3. The fuel injection valve of claim 2, wherein the chamfer (30), on its inner edge toward the combustion chamber, directly adjoins the inner jacket face of the longitudinal bore (6) of the hollow valve needle (5).

4. The fuel injection valve of claim 1, wherein the chamfer (30), on its inner edge toward the combustion chamber, directly adjoins the inner jacket face of the longitudinal bore (6) of the hollow valve needle (5).

5. The fuel injection valve of claim 1, wherein the valve needle (7) is guided, in its end region toward the combustion chamber, with little play in the hollow valve needle (5).

6. The fuel injection valve of claim 5, wherein the play amounts to less than 10 μm.

* * * * *